US005097677A

United States Patent [19]

Holtzapple

[11] Patent Number: 5,097,677

[45] Date of Patent: Mar. 24, 1992

[54] METHOD AND APPARATUS FOR VAPOR COMPRESSION REFRIGERATION AND AIR CONDITIONING USING LIQUID RECYCLE

[75] Inventor: Mark T. Holtzapple, College Station, Tex.

[73] Assignee: Texas A&M University System, College Station, Tex.

[21] Appl. No.: 410,108

[22] Filed: Sep. 20, 1989

Related U.S. Application Data

[63] Continuation-in-part of Ser. No. 143,522, Jan. 13, 1988.

[51] Int. Cl.[5] ..... F25B 1/06

[52] U.S. Cl. ..... 62/500; 62/513

[58] Field of Search ..... 62/268, 500, 513; 417/174

[56] References Cited

U.S. PATENT DOCUMENTS

| | | | |
|---|---|---|---|
| 2,404,660 | 7/1946 | Rouleau | 240/208 |
| 3,105,630 | 10/1963 | Lowler et al. | 230/31 |
| 3,111,820 | 11/1963 | Atchison | 62/505 |
| 3,210,958 | 10/1965 | Coyne | 62/324 |
| 3,250,460 | 5/1966 | Cassidy et al. | 230/210 |
| 3,482,768 | 12/1969 | Cirrincione et al. | 230/205 |
| 3,945,220 | 3/1976 | Kosfeld | 62/505 |
| 4,242,878 | 1/1981 | Brinkerhoff | 62/119 |
| 4,270,884 | 6/1981 | Lintonbon et al. | 417/15 |
| 4,273,514 | 6/1981 | Shore et al. | 417/15 |
| 4,490,993 | 1/1985 | Larriva | 62/304 |
| 4,573,324 | 3/1986 | Tischer et al. | 62/115 |
| 4,748,826 | 6/1988 | Laumen | 62/268 |

OTHER PUBLICATIONS

Reducing Energy Costs in Vapor-Compression Refrigeration and Air Conditioning Using Liquid Recycle, Parts, I, II, and III, M. T. Holtzapple Ashrae Transactions, 1989, v. 95.

J. F. Tucker II 12/6/90 Letter to Mr. Terry Young, with attachments.

D. Ged, Memorandum of 11/30/90 Phone Call from J. F. Tucker II.

Stoecker, Refrigeration and Air Conditioning (1958), McGraw-Hill Book Company, Inc., pp. 48-67.

van Breda Smith, Lost Work and Its Reduction in Refrigeration Processes (1980) Internal Journal of Refrigeration, vol. 3, pp. 323-330.

*Primary Examiner*—Henry A. Bennet

*Attorney, Agent, or Firm*—Arnold, White & Durkee

[57] ABSTRACT

A high efficiency evaporative intercooler/compressor assembly in which compressed refrigerant vapors are desuperheated by the introduction of a selected liquid refrigerant is disclosed. Additionally, the present invention relates to a method of introducing a refrigerant having a high latent heat of vaporization, such that the overall system efficiency is increased.

15 Claims, 4 Drawing Sheets

FIG.1
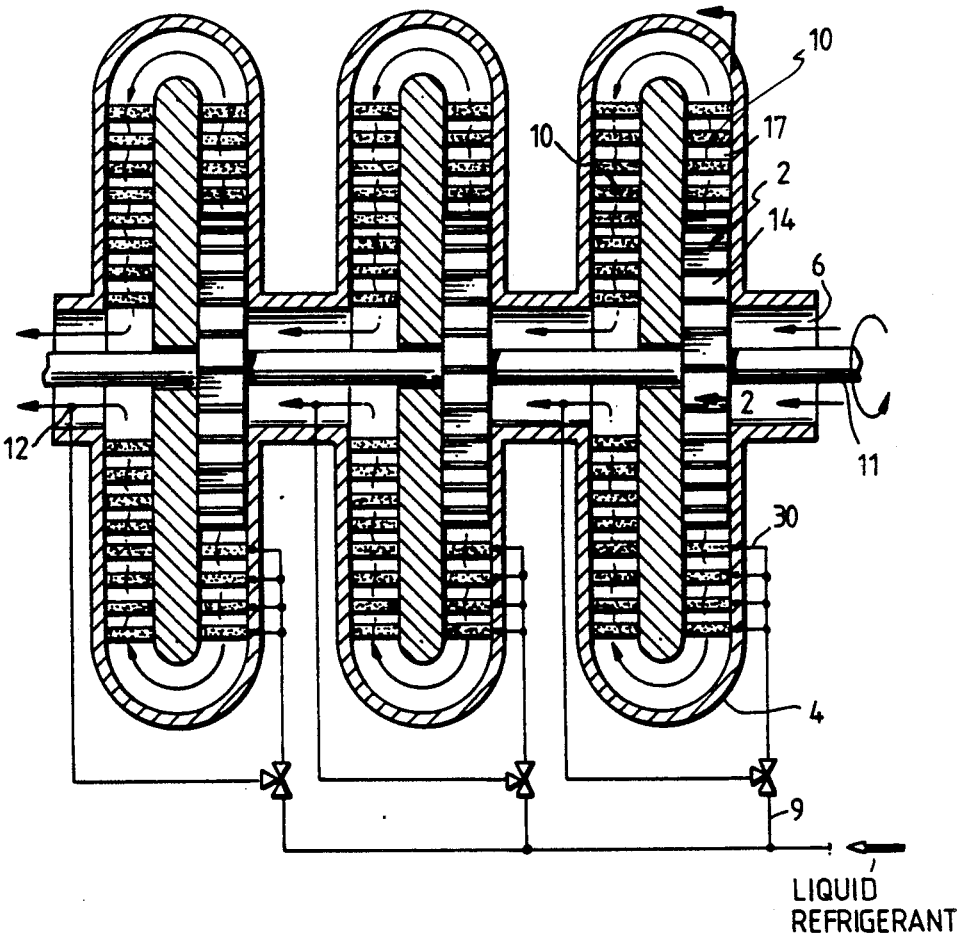
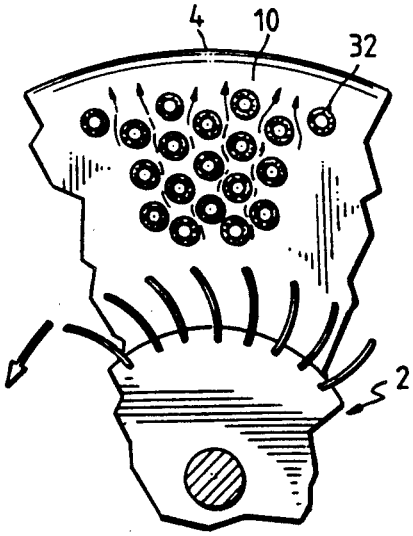
FIG.2
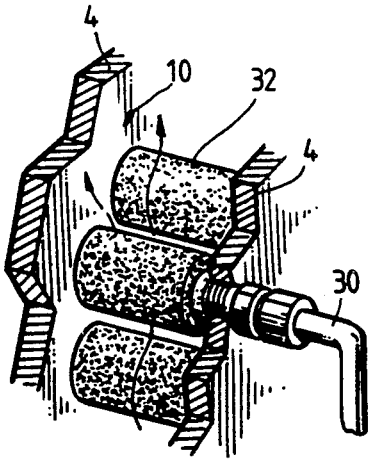
FIG.3

METHOD AND APPARATUS FOR VAPOR COMPRESSION REFRIGERATION AND AIR CONDITIONING USING LIQUID RECYCLE

This is a continuation-in-part of Ser. No. 143,522 filed Jan. 13, 1988.

BACKGROUND OF THE INVENTION

1. Field of the Invention

The present invention relates generally to a method and apparatus for increasing the overall efficiency of air conditioning systems by the introduction of a liquid refrigerant into the discharge of a single or multiple stage compressor. In one aspect of the invention, desuperheating of compressed discharge vapors is achieved by the evaporative introduction of a liquid refrigerant between multiple compression stages of an air conditioning or refrigeration system, where this refrigerant has a high latent heat of vaporization. Alternatively, desuperheating of compressor discharge vapors is achieved by the recycle of liquid refrigerant to the discharge of a single or multiple stage compressor.

2. Description of the Prior Art

Air conditioning and refrigeration systems are major consumers of power in both the U.S. and abroad. For example, it has been estimated that in the United States alone there are some 28,000 grocery outlets which annually consume some 1 million kWh of electricity. If such systems could be made only ten percent more efficient, the savings in electricity would translate into annual domestic savings of $140 million (at 5¢/kWh) or about five million barrels of oil.

In the normal operation of a refrigeration or air conditioning system, low pressure liquid refrigerant is evaporated to achieve a low-pressure vapor. The latent heat of vaporization required for this phase change produces the resultant refrigeration effect. These low pressure vapors are then compressed to a high-pressure, superheated state, where they then enter a high-pressure heat exchanger where energy is removed. In operation, the first section of the high-pressure heat exchanger functions as a desuperheater, while the latter section functions as a condenser. The condensed liquid from the condenser is then throttled through an expansion valve and is returned to the evaporator.

Functionally, a desuperheater is relatively space inefficient, since while the desuperheater removes only a small fraction of the energy from these compressed superheated vapors, the desuperheater often occupies a relatively large fraction of the overall high-pressure heat exchanger (i.e., desuperheater and condenser) area. This inefficiency results because the desuperheater has a low internal heat transfer coefficient due to the presence of a vapor film created during the normal operation of such a system. In comparison, the condenser has a relatively high internal heat transfer coefficient. Clearly then, when the entire high-pressure heat exchanger functions as a condenser, the increased condenser area lowers both the condenser temperature and pressure, thus resulting in a reduction of overall compressor work.

Since more energy is required to compress hot vapors than cool vapors, energy costs may thus be reduced by desuperheating superheated vapors produced during the compression process. Known in the art are devices designed to lower the temperature of the compressed vapors by the introduction of a liquid refrigerant to the exterior of a closed compression system. One such device is seen in U.S. Pat. No. 4,242,875 - Brinkerhoff. This patent describes an isothermal piston compressor apparatus wherein a compression chamber and a spray injection heat exchanger are placed in a heat exchange relationship to each other. More specifically in this patent, heat exchange coils from a closed compression chamber extend up into an evaporation chamber so that the gases flowing through these coils may be cooled prior to recompression.

Disadvantages of this concept include the undesired addition of "dead space" to the total compression system. The additional volume created by this coil may not be effectively "swept" by the compression piston, thus resulting in an overall lowering of system pressure and volumetric efficiency. Additional problems associated with this concept include the difficulty in exchanging heat between the compressed vapors and the evaporating liquid. In this, the external evaporation temperature must be substantially lower than the temperature of the compressor. This extreme heat gradient places an additional load on the compressor which attempts to purge the evaporation chamber.

The introduction of liquid directly into the compression chamber of refrigeration systems is also well-known in the art. Previous efforts in this area have described the spray introduction of liquid into the compressor chamber in a manner analogous to a fuelinjected automobile engine. Compressor systems including means for injecting liquid refrigerant directly into the compressor for mixture with the vapors being compressed therein are described for example in U.S. Pat. Nos. 3,109,297 - Rinehart and 3,105,633 - Dellario. In such compressor systems, liquid refrigerant from the condenser is introduced into the compression chamber through an injector port when the gas pressure in the compression chamber is lower than the pressure of the condenser. The injected liquid refrigerant vaporizes thereby cooling the discharge gases sufficiently to provide the desired cooling of the system motor by the discharged vapors.

A variety of other methods have also been pursued in order to provide lubrication, sealing and cooling of the system compressor. Such a system is seen for example in U.S. Pat. No. 3,105,630 Lowler et al. - wherein an oil or other suitable liquid is injected in the compression chamber of the compressor for the purpose of cooling, lubricating and sealing the internal parts of the compressor. Liquid recycle directly to the compression chamber is also described in U.S. Pat. No. 2,404,660 - Rouleau. This invention relates to a piston type compressor where an atomized liquid is delivered to the cylinder during that portion of the cylinder stroke in which compression heat is being generated, this liquid then being vaporized during compression.

The primary motivations for liquid recycle, have been to cool electric compression motors, prevent overheating of the compressor itself, and provide lubrication and sealing. The use of liquid recycle, however, generally provides an adverse effect on system efficiency if refrigerants with a low latent heat of vaporization (such as chlorofluorocarbons) are employed. Other disadvantages associated with this and similar designs include the possibility of "slugging" unvaporized refrigerant liquid, which often results in damage to the system compressor. Further, the short residence time in high-speed compressors makes it difficult to vaporize a significant amount of the liquid and achieve the desired cooling benefits. Although direct injection of the refrigerant liquid into the compressor achieves a maximum reduction in energy, direct injection is exceptionally difficult to implement in a practical manner.

Multistage compression with evaporative intercooling of the interstage vapors by saturation with recycle liquid can approach the performance of a direct injection system by infinitely increasing the number of compression stages. Further, multistage compression with evaporative intercooling can be adapted to any type of rotary, screw, scroll, centrifugal or piston compressor. However, many types of compressors, centrifugal compressors in particular, may be damaged by the introductions of a liquid refrigerant directly into the compressor intake. Therefore, for these and similar types of compressors, direct injection systems are not practical.

An evaporative intercooler using a liquid reservoir has also been described in the art. In his book "Refrigeration and Air Conditioning" (1958), Stoecker describes an evaporative intercooler where a tank filled with liquid refrigerant is placed between the compression stages, wherein superheated vapors passing through the liquid become saturated. This technique enhances energy efficiency for ammonia but has a detrimental energy efficiency effect for Refrigerant 12 (dichlorodifluoromethane). Further disadvantages associated with this technique include both the required space and overall capital costs, since in this system the tank diameter must be sufficiently large to ensure a vital disentrainment of liquid.

SUMMARY OF THE INVENTION

The present invention addresses many of the above referenced and other disadvantages of prior art system by providing a method and apparatus to recycle liquid refrigerant from the condenser to achieve an increase in energy efficiency. Using the method and apparatus of the present invention, overall efficiency of a given air conditioning or refrigeration system may be substantially enhanced. Alternatively or additionally, the present invention allows the size of a conventional air conditioning or refrigeration system high-pressure heat exchanger to be substantially reduced.

In one embodiment of the present invention, liquid refrigerant is recycled to evaporative intercoolers located between the stages of a multi-stage compression system. In this embodiment, a conventional multistage air conditioning or refrigeration system is modified to accommodate a spray injection arrangement, said arrangement being positioned downstream from one or more compressor assemblies. A refrigerant having a high latent heat of vaporization is then introduced through this spray injection arrangement into the superheated gas flow downstream from the compressor assembly(s), thus desuperheating the vapor stream. The injection of this selected refrigerant, i.e., one with a high latent heat of vaporization, results in an enhanced overall system efficiency.

The general concept of this embodiment is applicable to a variety of compressor types, such as piston compressors, scroll compressors or the like. In one preferred embodiment of the invention, a centrifugal compressor is designed such that vapors are pulled through a compressor inlet into the compressor housing, where they are then compressed by one or more impellers axially aligned in a number of circulation chambers. Downstream from each impeller are situated a series of inlet ports, said inlet ports intimately connected to an array of sintered metal wicks. These inlet ports are in turn connected to a refrigerant supply, preferably a supply of liquid refrigerant having a high latent heat of vaporization, such that the refrigerant may pass through the inlet ports into the compressor housing, where the refrigerant will then flow into and through the wick array for ultimate vaporization of the liquid refrigerant.

The wicks themselves are preferably formed such that refrigerant introduced through the core of the wick will capillate through the wicking material where it will then evaporate into the superheated vapor stream, thereby desuperheating the superheated vapor stream while minimizing the number of moles of additional refrigerant that must be compressed. Aditionally, since the refrigerant is introduced into the system in the form of evaporate, any danger that the compressor impellers will be damaged by the impacting of refrigerant droplets is substantially minimized.

The efficient operation of the above described system is dependent on the use of a refrigerant having a high latent heat of vaporization, e.g., water, alcohol, ammonia or methyl chloride. This is due to the overall tradeoff created between the beneficial desuperheating effect of adding liquid refrigerant and the detrimental effect of adding moles to the system which must necessarily be compressed. To this effect, the overall efficiency of the aforedescribed vapor compression system may actually be lowered if a refrigerant with a low latent heat of vaporization, such as a chlorofluorocarbon is used.

While energy savings may result from the use of liquid recycle in order to achieve interstage evaporative desuperheating energy savings can also result by recycling liquid to the compressor outlet in order to eliminate the need for a system desuperheater. Energy savings can thus be achieved if a conventional highpressure heat exchanger area is utilized. Liquid recycle allows the entire heat exchanger to function as a condenser with a resultant lowering of the condenser pressure and a reduction in compression energy.

In a second embodiment of the invention, liquid refrigerant is recycled to the discharge of the compressor in a single stage system, or to the final compressor in a multiple stage system, to achieve "post cooling" of the superheated vapors. This is advantageous from the standpoint that the superheated vapors are rapidly desuperheated to their dew point by the recycled vapors. Thus, the heat exchanger area which had previously been required to desuperheat the vapors (low internal heat transfer coefficient) can now function as a condenser (high internal heat transfer coefficient). Since more condenser area is thus made available, the system pressure is reduced, resulting in a corresponding reduction in compression energy.

The present system has a number of advantages over the prior art. Using the method and apparatus of the present invention, the overall heat exchanger area of an air conditioning or refrigerant system may be substantially reduced.

A second advantage of the present invention is the ability to achieve a substantially improved system efficiency, thus resulting in commensurate energy savings over conventional systems.

Yet a further advantage of the present system is its simple and ready application to centrifugal and various other type compressor systems with reduced danger of impeller damage or pitting.

BRIEF DESCRIPTION OF THE DRAWINGS

FIG. 1 illustrates a cross sectional illustration of a three-stage centrifugal compressor.

FIG. 2 illustrates a cross sectional view drawn across plane 2—2 in FIG. 2 illustrating a wick as it may be situated in the circulation chamber.

FIG. 3 illustrates a perspective cut-away view of a wick as it may be situated in the circulation chamber.

DESCRIPTION OF THE PREFERRED EMBODIMENT

A. Theoretical

Figure 4:
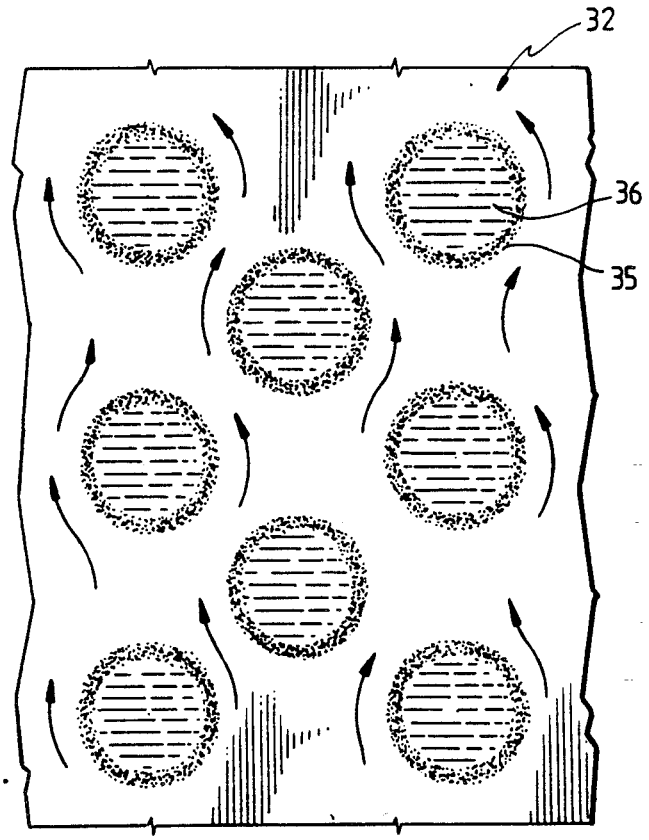
FIG. 4 illustrates a cross section of one embodiment of a wick.

The efficiency of a refrigeration system is determined by the "coefficient of performance" (COP) which is defined as the heat removed by the evaporation, Q, divided by the compressor work, W $$COP = \frac{Q}{W}$$

A higher COP indicates a more efficient refrigeration system.

The COP for a multi-stage refrigeration system with evaporative intercooling using ammonia as the refrigerant is shown below. (Note: evaporation temperature is 5° F., and the condenser temperature is always 86° F.)

| Number of Stages | COP | Improvement |
|---|---|---|
| 1 | 4.76 | 0.0% |
| 2 | 4.95 | 4.0% |
| 3 | 5.01 | 5.3% |
| . | . | . |
| . | . | . |
| . | . | . |
| infinite | 5.13 | 7.8% |

The COP for the single stage compressor (4.76) represents what is achievable with conventional refrigeration. As more compression stages are added (with evaporative intercooling between the stages), the COP improves. As shown, the maximum improvement occurs with an infinite number of compression stages. Seventy percent of this improvement, however, occurs in the first three stages.

The performance of an infinite stage compression system with evaporative intercooling is identical to the performance of a single compressor which utilizes direct spray injection of liquid into the compression chamber. The energy efficiency of such a system improves as the number of stages increases. Additionally, the size of the high-pressure heat exchanger of such a system decreases, since less compression heat must be eliminated and the desuperheater occupies less and less of the heat exchange area.

In the previous discussion, the size of the high pressure heat exchanger diminished since less heat exchange area was required to maintain a condenser temperature of 86° F. If the same size high-pressure heat exchanger is retained as is required for a conventional single stage refrigeration system, an even greater energy efficiency is observed. This improvement depends on a large number of factors.

Outside Heat Transfer
Coefficient = 100 Btu/h ft$^{2}$° F.
Desuperheater Inside Heat
Transfer Coefficient = 127 Btu/h ft$^{2}$° F.
Condenser Inside Heat
Transfer Coefficient = 4917 Btu/h ft$^{2}$° F.
Evaporator Temperature = 5° F.
Condenser Temperature of Conventional
Refrigeration System = 86° F.
Ambient Temperature = 66° F.
Refrigerant = Ammonia Using the foregoing assumptions, the COP for an infinite stage system is 5.26. This coefficient of performance represents 10% improvement over a conventional single-stage compressor. This improvement, however, is highly dependent on the outside heat transfer coefficient. If the external heat transfer resistance were eliminated, an increased COP of 6.19 would be realized which represents a 30% improvement.

The COP enhancement associated with post-cooling is not as great as that achieved with evaporative intercooling, yet it has utility since it requires minimal capital equipment. Using the same assumptions listed above the COP for a single-stage compressor with post cooling is 4.97; a 4.5% improvement compared to the conventional single-stage compressor without post cooling If the outside heat transfer resistance were eliminated, the COP would increase to a value of 5.71; a 20% improvement.

B. Preferred Embodiment

The present invention is illustrated by way of example in the accompanying drawings, in which FIG. 1 illustrates a cross sectional illustration of one preferred embodiment. In this embodiment, a three-stage centrifugal compressor is illustrated, although as noted, the invention has application to various other types of compressors.

As seen in FIG. 1, one or more impeller assemblies 2 are rotatably disposed along a common drive shaft 11 in a generally elliptical compressor housing 4, said housing defining an intake 6 and a discharge area 7. Each compressor housing 4 is designed to rotatably accommodate the impeller assembly 2, said impeller assembly 2 situated in a compression area 14 of the compressor housing 4. High pressure, superheated vapors flow from this compression area 14 downstream into a circulation gallery 10, where the vapors are desuperheated.

The design of the compression system, and hence the number of compression areas 14, may vary dependent upon a number of criteria including the output requirements of a given system. In such a fashion, vapors exiting the discharge 7 of one housing 4 may be directed into the intake 6 of a second housing 4 in a sequential arrangement as shown.

The circulation galleries 10 themselves may adopt a variety of configurations dependent on the desired application. In the embodiment illustrated in FIG. 1, the circulation chamber 10 is baffle shaped to enhance the travel path and desuperheating of vapors exiting the compression area 14. In other applications, the circulation chamber 10 may adopt a more linear configuration.

As illustrated in FIG. 1, the circulation gallery 10 exists as an integral part of the compressor housing 4. Alternately, a circulation gallery 10 may be situated outside or apart from the housing 4 itself, vapors from the compression area 14 flowing through such gallery 10 via a conduit or other means. In such a fashion, a conventional compression system may be easily modified to provide the advantages heretofore described in association with the present invention.

Preferably disposed within these circulation chambers 10 are a series of liquid refrigerant intakes 30 linked to a refrigerant supply 9. These intakes are distributed along the length of the circulation gallery 10 in an alternating array fashion to best enhance the distribution/-dispersion of the liquid refrigerant in the superheated vapor stream. In preferred embodiments and as illustrate in FIGS. 1-3, a series of wicks 32 may be coupled to these intakes 30 such that refrigerant, preferably a refrigerant having a high latent heat of vaporization, may flow into the wicks 32 for ultimate evaporative dispersion into the superheated vapor stream. In this fashion, refrigerant enters the system solely in the form of evaporate, thus minimizing the possibility that vapor drops or droplets will impact on downstream mechanical parts. To accomplish this goal also, the wicks 32 are preferably disposed between the walls of each compressor housing 4 such that the wicks 32 are situated so that their major axis is aligned normal to vapor flow. Although only a few intakes 30 are shown in FIGS. 1 and 3, all wicks 32 receive a flow of liquid refrigerant as above described..

FIG. 4 illustrates a cross-section of a wick 32 as it may be used in the aforedescribed system. Liquid refrigerant is introduced through the hollow core 36 defined in a matrix 35. Preferably the matrix 35 is formed of sintered metal, such that refrigerant introduced through the core 36 percolates toward the outer diametrical extent of the wick where the refrigerant is heated to its vapor point, where it then enters the superheated vapor stream in the form of evaporate.

The rate at which refrigerant is introduced to the system must be regulated to avoid flooding the individual compression stage. This can be accomplished by sensors which measure the temperature and pressure at the inlet of the next compression stage. These sensors are shown at 12 in FIG. 1. This liquid flow rate must be controlled so that a slight amount of superheat remains in the vapors.

While the aforedescribed wick design effectively minimizes the introduction of refrigerant droplets into a given compressor system, especially high velocity compressor systems may result in the periodic and undesired accumulation of liquid refrigerant at the wick's outer diametrical extent. This refrigerant collection is partially a result of the tendency of refrigerant injected into the wick's core 36 to pool or puddle, thus effectively supersaturating a portion of the wick matrix 35. Such liquid puddles may be entrained in the high-velocity fluid flow and enter the next compression stage, thus posing the danger of impeller pitting or cracking. In such high velocity applications it is therefore advantageous to coat the exterior of the wick matrix 35 with an impermeable metal coating or jacket.

Figure 5:
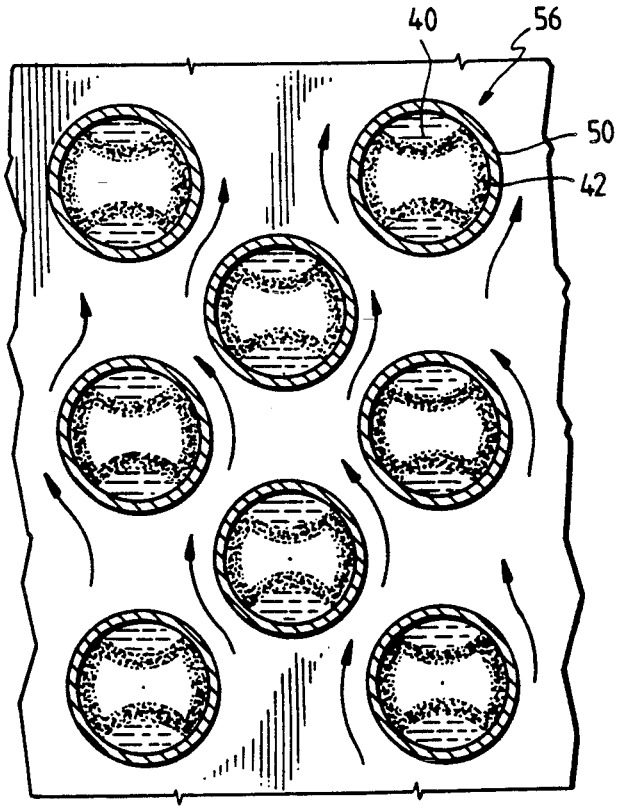
FIG. 5 illustrates a cross section of an alternate embodiment of a wick.

In an alternate aspect of this embodiment as illustrated in FIG. 5, a wick 56 may be provided with an impermeable metal jacket 50. This jacket 50 may be smooth of may be augmented with fins or spines (not shown) to enhance heat transfer. In the embodiment illustrated in FIG. 5, a series of hollow longitudinal cores or feeder tubes 40 are formed in the outer periphery of the wick matrix 42 coating the interior of the metal jacket 50. Liquid refrigerant directed along this feeder tube 40 soaks or seeps into the matrix 42 immediately surrounding the feeder tube 40. Since the metal jacket 50 is in contact with the superheated gas stream, it will quickly acquire a heat sufficient to evaporate refrigerant proximate or appurtenant to the jacket 50, through the seeping or percolation process through the matrix 42. Hence, refrigerant will be evaporated from the innermost periphery of the matrix 42. Preferably this jacket 50 extends along the longitudinal extent of the wick 56. The distal end of the wick 56, however, is left open so that vaporized refrigerant can exit through the open end into the superheated gas stream. In such a fashion, refrigerant injected through feeder tube 40 is more evenly distributed along and through the matrix 42 of the wick 56, and along the interior of the metal jacket 50, for ultimate dispersion in the superheated gas stream.

Figure 6:
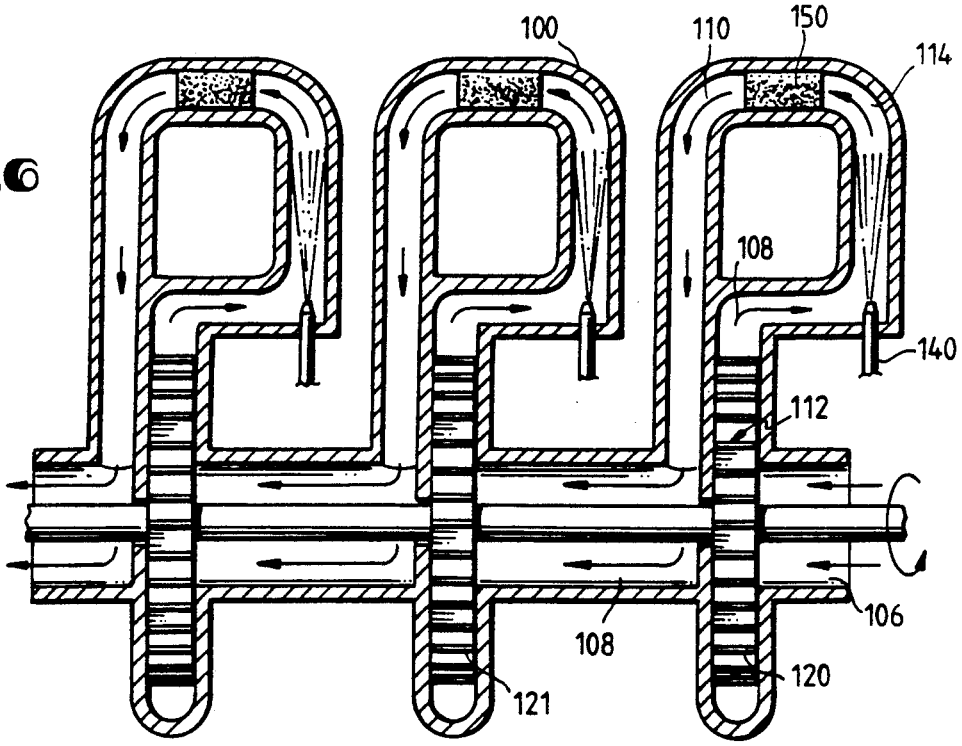
FIG. 6 is a cross sectional illustration of an alternate embodiment of the present invention in which liquid refrigerant is sprayed directly in the superheated vapor stream.

The aforedescribed apparatus described in association with FIG. 5 requires that heat be transferred from the flowing gases to the metal surfaces of the compressor system. Large amounts of surface area may thus be required to transfer this heat. At some point, the pressure drop associated with this increased surface area may negate the benefit of introducing liquid into the compressor. In recognition of this problem, FIG. 6 illustrates an alternate embodiment in which liquid refrigerant is sprayed directly into the superheated vapor stream downstream from the compressor. in this embodiment, the compressor housing 100 defines an inlet 106 and outlet 108. The housing 100 further defines a circulation gallery 110, and a compression area 112, the circulation gallery 110 existing downstream from the compression area 112 in a loop arrangement. In this fashion, gases compressed by the impeller 120 in the compression area 112 are forced to navigate a holding area 114 prior to returning to the next impeller 121. A spray inlet 140 is positioned at the entrance to the holding area 114, said inlet being coupled to a liquid refrigerant system (not shown), such that liquid refrigerant may be sprayed directly into the superheated vapor stream downstream from the impeller 120. Any liquid droplets that do not evaporate in the gas stream are collected by a demister 150 placed after the holding area 114.

A sensor (not shown) placed downstream from the demister measures the pressure and temperature of the flowing vapors. The flow rate of liquid refrigerant into the spray inlet 140 will be regulated such that there is always a slight amount of superheat, thus ensuring that liquid droplets do not enter the next compression stage.

Figure 7:
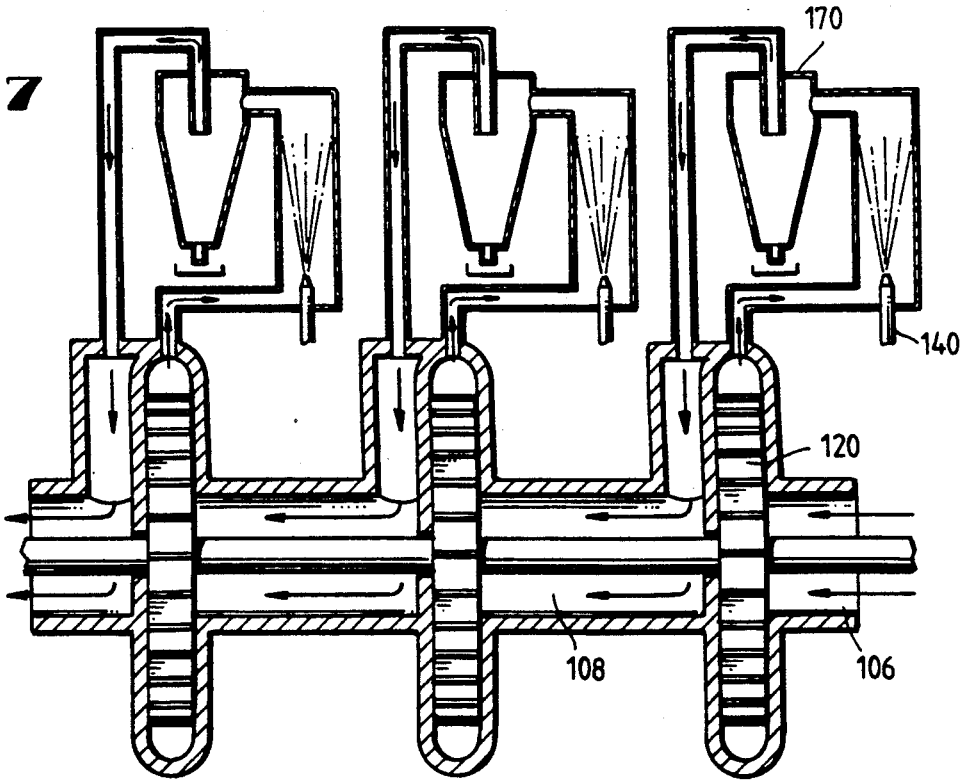
FIG. 7 is a cross sectional illustration of another embodiment of the present invention which includes a cyclonic separator.

In a third aspect of this embodiment illustrated in FIG. 7, the compressor housing 100 is generally arranged as earlier described in FIG. 6. In this embodiment, however, spray droplets not evaporated into the superheated gas stream are removed by a cyclonic separator 170 rather than by a demister.

Figure 8B:
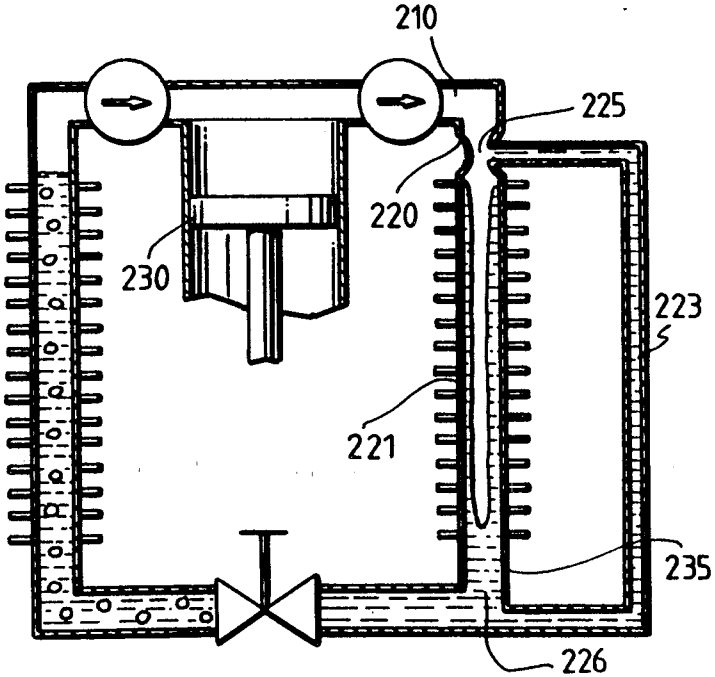
FIGS. 8A–8B schematically illustrates how liquid refrigerant may be recycled to the compressor outlet to achieve desuperheating in a (A) pumped recycle system, and a (B) aspirated recycle system.
Figure 8A:
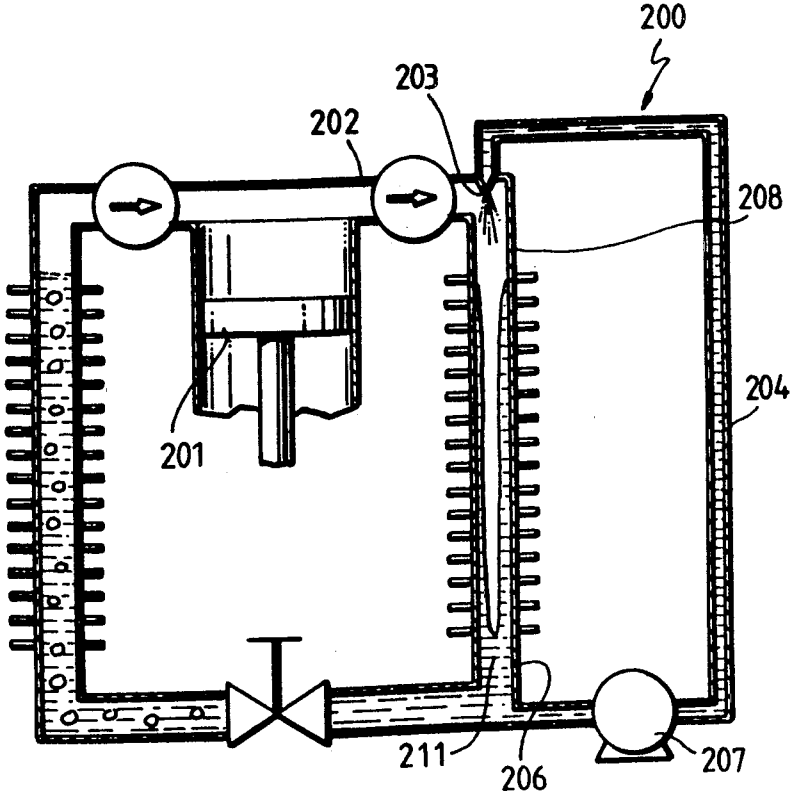

FIGS. 8A-B schematically illustrate a second embodiment of the present invention where a selected liquid refrigerant is recycled to the discharge area of a compressor assembly. Though FIGS. 8A–B are shown in relation to a piston-type compressor, the inventive concept herein described is applicable to a variety of compressor types.

The system illustrated in FIG. 8A employs a liquid pump injector system 200 to recycle liquid refrigerant into the superheated vapors immediately exiting the compressor 201. In this embodiment, a connector assembly 204 is coupled to a lower portion of a condenser 206 where system refrigerant has condensed and pooled in liquid form 211. This liquid refrigerant 211 is recycled to the immediate discharge 202 downstream of the compressor 201. In this embodiment, the recycling is accomplished via a conventional hydraulic pump 207. Liquid refrigerant 211 is introduced through a spray nozzle 203 or the like, such that the superheated vapors moving downstream from the compressor 201 through the discharge 202 will be desuperheated even before they enter the upper portion 208 of the condenser, thus enabling a reduction in the overall size of the high pressure heat exchange. Alternately, the described recycling of liquid refrigerant enables an enhancement in overall system efficiency.

A variation of this system is illustrated in FIG. 8B. In this embodiment also, a connector assembly 223 is coupled between the lower portion of the condenser 235 and the discharge 210 of the compressor 230. In this embodiment, however, liquid refrigerant 226 is urged upward into the discharge 210 by the incorporation of a Venturi throat 220 at the uppermost extent of the condenser 225. The velocity of the vapors exiting the compressor 230 is increased through the Venturi throat 220, thus creating an area of lower pressure at this area 225 such as to cause a partial vacuum sufficient to recycle the liquid refrigerant 226. In such a fashion, the implementation of a hydraulic pump is not required.

The recycling scheme described in association with FIGS. 8A and 8B may be used with any refrigerant regardless of the latent heat of vaporization. Hence refrigerants such as Freons may be used in addition to ammonia, water or other refrigerants having a high latent heat of vaporization.

While the particular methods and apparatus for vapor compression and air conditioning herein shown and described are believed to be fully capable of attaining the objects and providing the advantages hereinbefore stated, it is to be understood that these are merely illustrative of the presently preferred embodiment of the invention and that no limitations are intended to the detail of construction or design herein shown other than as defined in the appended claims:

What is claimed is:

1. A multistage evaporative compressor assembly in which compressed refrigerant vapors are desuperheated by the introduction of a liquid refrigerant having a high latent heat of vaporization, comprising:

a compressor housing including a compression area, an inlet, and a discharge;

a compression means disposed in said compression area and positioned between the inlet and the discharge;

a circulation gallery positioned between said discharge area and the inlet area of the next, downstream compression stage such that vapor from said discharge area flows through said circulation gallery;

a heat exchange array comprising a network of capillaries positioned in the circulation gallery such that their major axis is normal to the flow direction of the compressed vapors into which may flow the liquid refrigerant, and around which may flow said refrigerant vapors, said heat exchange array disposed in said circulation gallery such that vapors introduced into said gallery from said discharge area flow through said array, said array adapted to selectively remove a majority of the superheat of the compressed vapors.

2. The compressor assembly of claim 1 where the refrigerant includes ammonia, methyl chloride, water, alcohol or combinations thereof.

3. The compressor assembly of claim 1 wherein the capillaries are comprised of porous wicks adapted to receive liquid refrigerant through an inner core and disperse vaporized refrigerant at their outer, vapor contacting periphery.

4. The compressor assembly of claim 3 wherein the wicks are comprised of sintered metal.

5. The compressor assembly of claim 1 wherein the capillaries consist of an elongate, impermeable jacket in which is disposed a porous matrix, said jacket being open at one end to receive liquid refrigerant and being open at the other end to discharge vaporized refrigerant.

6. The compressor assembly of claim 5 wherein the porous matrix is comprised of sintered metal.

7. The compressor assembly of claim 5 wherein the outer jacket is augmented with spines or fins to increase the negative heat transfer to the compressed vapors.

8. A multistage evaporative compressor assembly in which compressed refrigerant vapors are desuperheated by the introduction of a liquid refrigerant having a high latent heat of vaporization, comprising:

a compressor housing including a compression area, an inlet, and a discharge;

a compression means disposed in said compression area and positioned between the inlet and the discharge;

a circulation gallery positioned between said discharge area and the inlet area of the next, downstream compression stage such that vapor from said discharge area flows through said circulation gallery;

a heat exchange array comprising a network of capillaries into which may flow the liquid refrigerant, and around which may flow said refrigerant vapors, said heat exchange array disposed in said circulation gallery such that vapors introduced into said gallery from said discharge area flow through said array, said array adapted to selectively remove a majority of the superheat of the compressed vapors; and a means for introducing liquid refrigerant droplets and for purging the compressed system vapors of any unvaporized liquid components.

9. The compressor assembly of claim 8 where the refrigerant includes ammonia, methyl chloride, water, alcohol or combinations thereof.

10. A high efficiency, multistage compressor wherein compressed, superheated vapors are desuperheated by the introduction of a liquid refrigerant having a high latent heat of vaporization, comprising:

a compressor housing, said housing defining a compression area and one or more circulation galleries, said compressor housing further defining an inlet and a discharge;

said circulation gallery positioned downstream from said compression means, such that superheated vapors from said compression means flow through said circulation gallery;

a compression means disposed in said compression area of said compressor housing such that gases entering the inlet are drawn into the compression means where they are compressed and circulated through the circulation gallery;

an injector means disposed in the circulation gallery such that the liquid refrigerant may be introduced into the superheated vapors discharged from the compression means wherein a portion of said refrigerant evaporates to remove a majority of the superheat of the compressed vapors; and a purging means situated downstream from said injector means in said circulation gallery such that non-vaporized refrigerant will be removed from the vapor stream.

11. The multistage compressor of claim 10 wherein the refrigerant includes ammonia, methyl chloride, alcohol, water or combinations thereof.

12. The multistage compressor of claim 10 wherein the purging means comprises a cyclone separator or demister.

13. The multistage compressor of claim 10 wherein the injector means includes an array of sintered metal wicks situated in the circulation gallery, said wicks adapted to receive liquid refrigerant through an inner core and disperse vaporized refrigerant at their outer vapor-contacting periphery.

14. The multistage compressor of claim 13 wherein the sintered metal wicks further include an impermeable jacket partially disposed along their length such the liquid refrigerant may be injected through one end and vaporized refrigerant dispersed through the other end into the vapor stream.

15. The compressor assembly of claim 9 wherein the purging means includes a demister or cyclone separator.

* * * * *